US010234199B2

(12) United States Patent
Hahn

(10) Patent No.: US 10,234,199 B2
(45) Date of Patent: Mar. 19, 2019

(54) AIR DISPENSER

(71) Applicant: Hahn Marketing LLC, Taylor, MI (US)

(72) Inventor: Richard J. Hahn, Northville, MI (US)

(73) Assignee: Hahn Marketing LLC, Taylor, MI (US)

( * ) Notice: Subject to any disclaimer, the term of this patent is extended or adjusted under 35 U.S.C. 154(b) by 0 days.

(21) Appl. No.: 15/651,498

(22) Filed: Jul. 17, 2017

(65) Prior Publication Data

US 2019/0017743 A1 Jan. 17, 2019

(51) Int. Cl.

| | |
|---|---|
| ***F26B 21/00*** | (2006.01) |
| ***B05B 1/00*** | (2006.01) |
| ***B05B 1/04*** | (2006.01) |
| ***F26B 3/04*** | (2006.01) |
| ***F26B 9/06*** | (2006.01) |

(52) U.S. Cl.

CPC ..... *F26B 21/004* (2013.01); *B05B 1/005* (2013.01); *B05B 1/044* (2013.01); *F26B 3/04* (2013.01); *F26B 9/06* (2013.01)

(58) Field of Classification Search

CPC .. F26B 21/004; F26B 3/04; F26B 9/06; B05B 1/005; B05B 1/044

USPC ..... 239/463, 499, 568, 592, 595, 597–599, 239/DIG. 21

See application file for complete search history.

(56) References Cited

U.S. PATENT DOCUMENTS

| | | | | |
|---|---|---|---|---|
| 2,940,418 | A * | 6/1960 | Penrod | C23C 2/20 239/597 |
| 4,270,702 | A * | 6/1981 | Nicholson | B05C 11/06 239/597 |
| 2003/0115709 | A1* | 6/2003 | Haruch | B08B 5/023 15/309.2 |
| 2010/0120350 | A1* | 5/2010 | Pucciani | F26B 21/004 454/188 |

* cited by examiner

*Primary Examiner* — Steven J Ganey

(74) *Attorney, Agent, or Firm* — Dinsmore & Shohl LLP

(57) ABSTRACT

An air dispenser for a paint drying chamber having a housing with a top, bottom, and a curvilinear wall extending between the top and the bottom. The wall has an elongated outlet extending between the top and the bottom and an air outlet is formed in the top or the bottom. The wall is generally circular in cross-sectional shape but with an outwardly protruding wall section adjacent the air outlet.

6 Claims, 2 Drawing Sheets

AIR DISPENSER

BACKGROUND OF THE INVENTION

I. Field of the Invention

The present invention relates generally to an air dispenser for use with a paint drying chamber.

II. Description of Related Art

Motor vehicles, such as cars and trucks, are typically painted on their outside surface. In view of government regulations limiting the amount of VOCs that can be released to the atmosphere, many automotive manufacturing companies now use water-based paint for their automotive vehicles.

During the manufacturing process, the water-based paint is typically sprayed on the outside surface of the vehicle. In order to dry the paint, heated air is circulated around the vehicle until the water evaporates and the paint cures.

Consequently, for maximum efficiency on the automotive production line, it is desired to dry or cure the water-based paint as quickly as possible thus reducing the overall time required to manufacture the automotive vehicle.

There have been previously known air drying systems used in the paint chambers for automotive vehicles. These previously known systems circulated moderately warm air around the paint drying chamber in order to cure or dry the water-based paint. In some cases, a relatively prolonged period was required in the drying chamber in order to completely dry and cure the paint.

SUMMARY OF THE PRESENT INVENTION

The present invention provides an air dispenser particularly suitable for a paint drying chamber which overcomes the disadvantages of the previously known air dispensers.

In brief, the air dispenser of the present invention includes a top, a bottom, and a curvilinear side wall extending between the top and the bottom. The wall includes an elongated outlet extending between the top and the bottom.

An air inlet is formed in the top or the bottom so that air entering the interior of the housing flows out through the slot and into the chamber to dry the automotive vehicle.

Unlike the previously known air dispensers, in the present invention the housing is generally circular in cross-sectional shape but with an outwardly protruding wall section adjacent its air outlet. This outwardly protruding wall section creates turbulence in the air within the interior of the air dispenser thus further heating the air within the interior of the air dispenser. In practice, temperature increases of between 25° F. and 42° F. have been achieved as compared to similar air dispensers but without the outwardly protruding wall section adjacent the air outlet.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
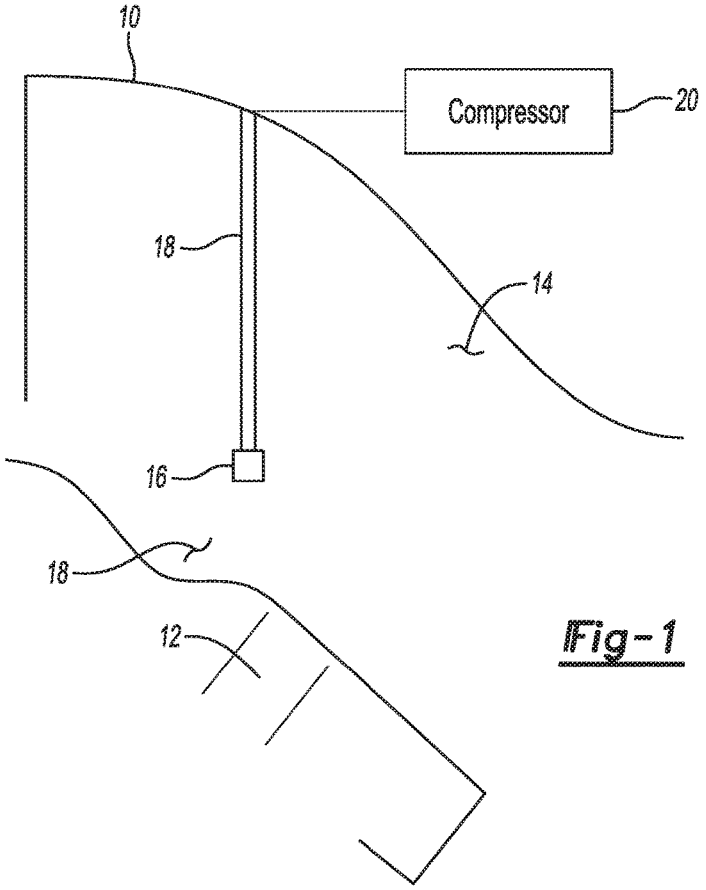
FIG. 1 is a perspective view illustrating the air dispenser of the present invention installed in a paint spray booth.

With reference first to FIG. 1, a portion of a conventional paint spray booth 10 of the type used to cure the exterior paint on an automotive vehicle 12 is shown. The paint spray booth 10 in the conventional fashion includes outer walls 14 which form a chamber in which the vehicle 12 is positioned. The exterior of the vehicle 12 may be either painted within the chamber 10 or, painted outside the chamber 10 and then moved into the drying chamber 10 to cure the paint.

In order to cure the paint, at least one, and more typically several, air dispensers 16 are positioned within the chamber 14. These air dispensers 16 circulate air around the vehicle 12 in order to dry the paint on the vehicle 12. The air dispenser 16 is fluidly connected by an air inlet pipe 18 to a suitable compressor 20 to produce the air flow within the drying chamber 14.

Figure 2:
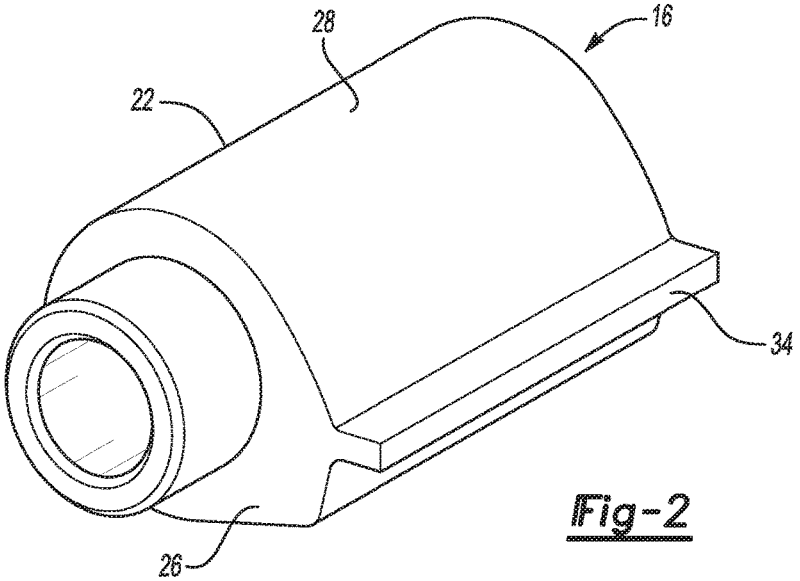
FIG. 2 is an elevational view of the preferred embodiment.
Figure 3:
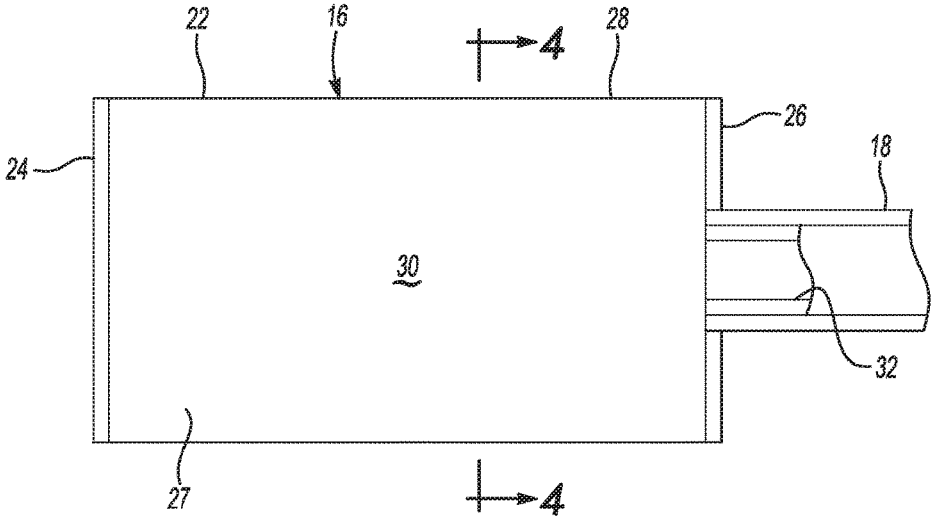
FIG. 3 is a side view illustrating the preferred embodiment of the invention.
Figure 4:
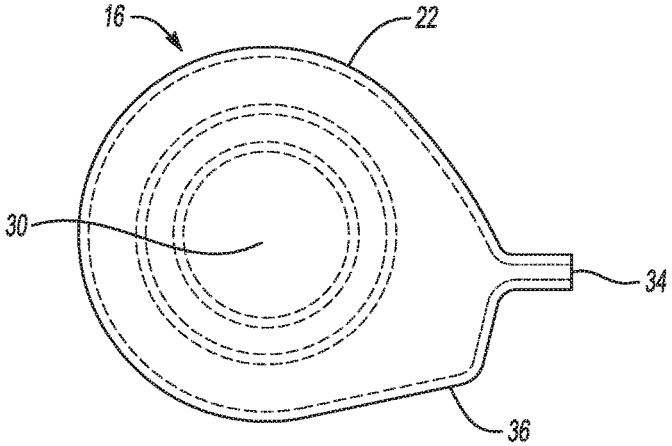
FIG. 4 is a view taken substantially along line 4-4 in FIG. 2.

With reference now to FIGS. 2-4, the air dispenser 16 is there shown in greater detail and comprises an outer housing 22 which may be constructed of any suitable non-rusting material, such as aluminum or plastic. The housing 22 itself includes a bottom wall 24, a top wall 26, and a curvilinear side wall 28 extending in between the top wall 26 and bottom wall 24 thus forming an interior chamber 30 between the top 26, bottom 24, and side wall 28.

As best shown in FIGS. 1 and 3, an air inlet pipe 32 is attached to either the housing top 26 or housing bottom 24. This inlet pipe 32 is adapted for connection with the air inlet pipe 18 so that pressurized air can be supplied to the interior chamber 30 from the compressor 20 through the pipe 18.

As best shown in FIGS. 2 and 4, an elongated air outlet 34 extends generally perpendicularly between the housing top 26 and bottom 24. The air outlet 34 has a length preferably in the range of 3-7 inches and a width between 0.100 and 0.200 inch. Furthermore, although the air outlet 34 is illustrated in FIG. 2 as extending entirely between the top 26 and bottom 24, the air outlet 34 may terminate short of either the top 26, bottom 24, or both without deviating from the spirit or scope of the invention.

With reference now particularly to FIG. 4, the wall 22 is generally circular in cross-sectional shape from one side of the outlet 34 to the other side of the outlet 34 but with an outwardly protruding wall section 36 closely adjacent one side of the outlet 34. As such, the cross-sectional shape of the chamber 30 is asymmetrical relative to the outlet 34 with the outwardly protruding portion 36 being asymmetrical with the opposite side of the outlet 34.

In practice, the compressor 20 provides compressed air to the interior 30 of the nozzle 16 and this pressurized air ultimately flows through the outlet 34. However, unlike the previously known air dispensers, the outwardly protruding portion 36 of the side wall 28 creates additional turbulence within the interior chamber 30 of the air dispenser 16.

This additional turbulence within the interior chamber 30 of the air dispenser 16 provides two important advantages. One, the turbulence effectively creates back pressure which results in additional heating of the air prior to its exit from the air dispenser 16. This, in turn, results in an increase in temperature typically of between 25° F. and 42° F. from the air dispenser 22. This higher temperature facilitates the drying of the water-based paint on the vehicle 12 in the paint spray booth 14.

Secondly, the turbulence caused by the outwardly protruding portion 36 of the side wall 28 creates a turbulent air flow through the air dispenser outlet 34. This turbulent air flow further enhances the drying of the paint on the vehicle 12 since the turbulent air flow breaks up the laminar air flow movement common to the previously known air dispensers.

Having described my invention, many modifications thereto will become apparent to those skilled in the art to which it pertains without deviation from the spirit of the invention as defined by the scope of the appended claims.

I claim:

1. An air dispenser for a paint drying chamber, said air dispenser comprising:

a housing having a top, a bottom and a curvilinear wall extending between said top and said bottom, said top, bottom, and curvilinear wall defining an interior chamber, said curvilinear wall having an elongated outlet extending between said top and said bottom, at least one of said top and said bottom having an air inlet, wherein said curvilinear wall is generally circular in cross-sectional shape but with an outwardly protruding wall section adjacent said air outlet, wherein a cross-sectional shape of said interior chamber is asymmetrical relative to said outlet.

2. The air dispenser as defined in claim 1 wherein said outlet has a width and an elongated length and wherein said length of said outlet is generally perpendicular to said bottom.

3. The air dispenser as defined in claim 2 wherein said width of said outlet is 0.100 to 0.200 inch.

4. The air dispenser as defined in claim 1 wherein a length between said top and said bottom is 3-7 inches.

5. The air dispenser as defined in claim 1 wherein said top and said bottom lie in parallel planes.

6. The air dispenser as defined in claim 1 wherein said inlet is generally circular in cross-sectional shape.

* * * * *